US008083700B2

(12) United States Patent
Tanizawa et al.

(10) Patent No.: US 8,083,700 B2
(45) Date of Patent: Dec. 27, 2011

(54) CHAIR TYPE MASSAGER

(75) Inventors: Takayoshi Tanizawa, Kadoma (JP); Satoshi Kajiyama, Kadoma (JP); Masamichi Miyaguchi, Kadoma (JP); Daisuke Tsukada, Kadoma (JP); Fumihiro Nishio, Kadoma (JP); Takeo Iijima, Kadoma (JP); Yuichi Nishibori, Kadoma (JP)

(73) Assignee: Panasonic Electric Works Co., Ltd., Kadoma-Shi, Osaka (JP)

( * ) Notice: Subject to any disclaimer, the term of this patent is extended or adjusted under 35 U.S.C. 154(b) by 1161 days.

(21) Appl. No.: 11/892,049

(22) Filed: Aug. 20, 2007

(65) Prior Publication Data

US 2008/0048475 A1 Feb. 28, 2008

(30) Foreign Application Priority Data

Aug. 28, 2006 (JP) ..... 2006-231166

(51) Int. Cl.
*A61H 9/00* (2006.01)

(52) U.S. Cl. ..... 601/148; 601/151

(58) Field of Classification Search ..... 601/23, 601/24, 26, 27, 29, 98–105, 148–152
See application file for complete search history.

(56) References Cited

U.S. PATENT DOCUMENTS

| | | | | |
|---|---|---|---|---|
| 6,491,652 | B1 * | 12/2002 | Hata et al. | 601/151 |
| 7,549,966 | B2 * | 6/2009 | Fujii et al. | 601/133 |
| 2006/0217643 | A1 * | 9/2006 | Yonekawa et al. | 601/148 |
| 2007/0287941 | A1 * | 12/2007 | Yoda et al. | 601/151 |

FOREIGN PATENT DOCUMENTS

| | | |
|---|---|---|
| JP | 2005-152260 | 6/2005 |
| WO | 2005/082316 | 9/2005 |

OTHER PUBLICATIONS

The Chinese Office Action dated Apr. 23, 2010 and English translation thereof.

* cited by examiner

*Primary Examiner* — Steven Douglas
(74) *Attorney, Agent, or Firm* — Bacon & Thomas, PLLC

(57) ABSTRACT

A chair type massager includes a seat part on which a person to be treated sits on, a backrest part with a reclining mechanism to perform a raising/tilting operation, and right and left armrest parts in which the arms are inserted. The massager further includes air bags provided at the armrest parts, the air bags holding the arms placed in the armrest part by being swelled by air supplied from an air supply pump; a control part for controlling the raising/tilting operation of the backrest part and the air supply to the air bags; and a manipulation part for giving instructions to the control part. When controlling the reclining mechanism to tilt the backrest part in response to the instructions from the manipulation part to perform the arm stretch, the control part controls the air supply pump to supply air into the air bags intermittently.

4 Claims, 7 Drawing Sheets

CHAIR TYPE MASSAGER

FIELD OF THE INVENTION

The present invention relates to a chair type massager that performs arm stretch.

BACKGROUND OF THE INVENTION

A conventional chair type massager includes a treating element that performs a back massage, a driving mechanism and the like in a backrest part. The conventional massager has been multi-functionalized by extending parts to be massaged from the back to other parts of a human body or including the functions of stretching the arms, legs, waist and other parts in addition to the function of massaging the back by the treating element.

For example, the conventional massager includes a plurality of air bags holding arms or legs so that the parts of a human body to be treated, such as the back and other parts, can be restricted from moving. In this state, a mechanical massage performed by the treating elements is combined with a massage performed by the air bags or with a raising/tilting operation (reclining operation) of the backrest part, thereby performing more effective massage or stretch. (see, e.g., Japanese Patent Laid-Open Application Nos. 2005-013463 and 2005-152260).

The massagers of the aforementioned JP-A-2005-013463 and JP-A-2005-152260, however, have following problems, when the arm stretch is performed. These massagers have air bags in armrest parts in which arms are inserted. As air is supplied into the air bags, arms are fixedly held by the swelled air bags, and the arm stretch is performed by tilting a backrest part. However, it takes a predetermined time to tilt the backrest part backward until a user feels that the arms are stretched. If the air is continuously supplied to the air bags to hold the arms while the predetermined time passes, the bloodstreams of the arms are obstructed so that the arms become tired and the massage feeling gets worse.

To avoid such an excessive air supply described above, a pressure retaining valve (to be described later) that maintains air within the air bags at a constant level can be used to control the pressure applied to the arm at a specific level. However, in such a case, a space is required for installing the pressure retaining valve. Moreover, since the pressure retaining valve is expensive compared to the simple opening/closing valve, this causes an additional cost. The pressure retaining valve is a valve such as a back pressure valve or a primary pressure regulating valve. If pressure is higher than the predetermined pressure, the pressure retaining valve releases extra pressure and maintains the pressure at a specific level before entering through the pressure retaining valve. That is, the pressure retaining valve maintains a secondary pressure so as to be constant, by releasing the primary pressure. In addition, the pressure retaining valve is distinguished from a pressure reducing valve.

SUMMARY OF THE INVENTION

The present invention provides a chair type massager which is capable of performing an arm stretch by holding and fixing the arms to be comfortable while realizing a space-saving and economical configuration, without deteriorating a massage feeling.

In accordance with an aspect of the present invention, there is provided a chair type massager which includes a seat part on which a person to be treated sits; a backrest part with a reclining mechanism to perform raising/tilting operation; and right and left armrest parts in which the arms are placed. The massager further includes air bags provided at the armrest parts and expanded by air supplied from an air supply pump that fixedly holds the arms placed in the armrest parts; a control part that controls the raising/tilting operation of the backrest part and simultaneously controls the air supply into the air bags; and a manipulation part that gives instructions to the control part. When the control part tilts the backrest part by controlling the reclining mechanism under the operational instructions from the manipulation part to perform the arm stretch, the control part controls the air supply into the air bags by the air supply pump to be intermittently performed.

In accordance with the present invention, when the backrest part is tilted to execute the stretching, since the air supply into the air bags for holding arms is intermittently performed, the pressure of the air bags can be properly maintained without being excessively increased. Therefore, the defects such as the oppressive sensation on arms, the obstruction of the bloodstream and the tiredness are prevented, so that the arm stretch can be comfortably performed. Furthermore, since an expensive pressure retaining valve is not required, the massager is realized in a space-saving and inexpensive configuration.

BRIEF DESCRIPTION OF THE DRAWINGS

The above and other objects and features of the present invention will become apparent from the following description of example embodiments, given in conjunction with the accompanying drawings, in which.

DETAILED DESCRIPTION OF THE EMBODIMENTS

Figure 1:
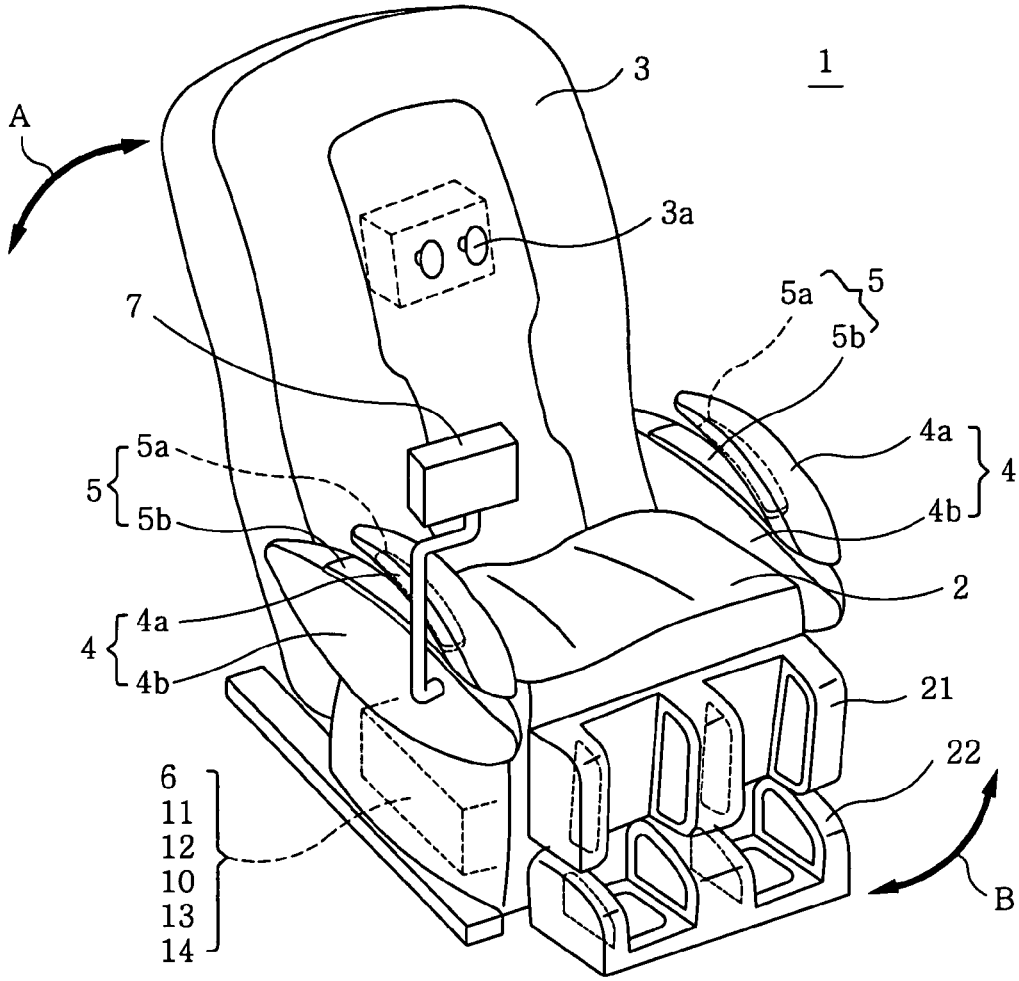
FIG. 1 is a perspective view of a chair type massager in accordance with an embodiment of the present invention.
Figure 2:
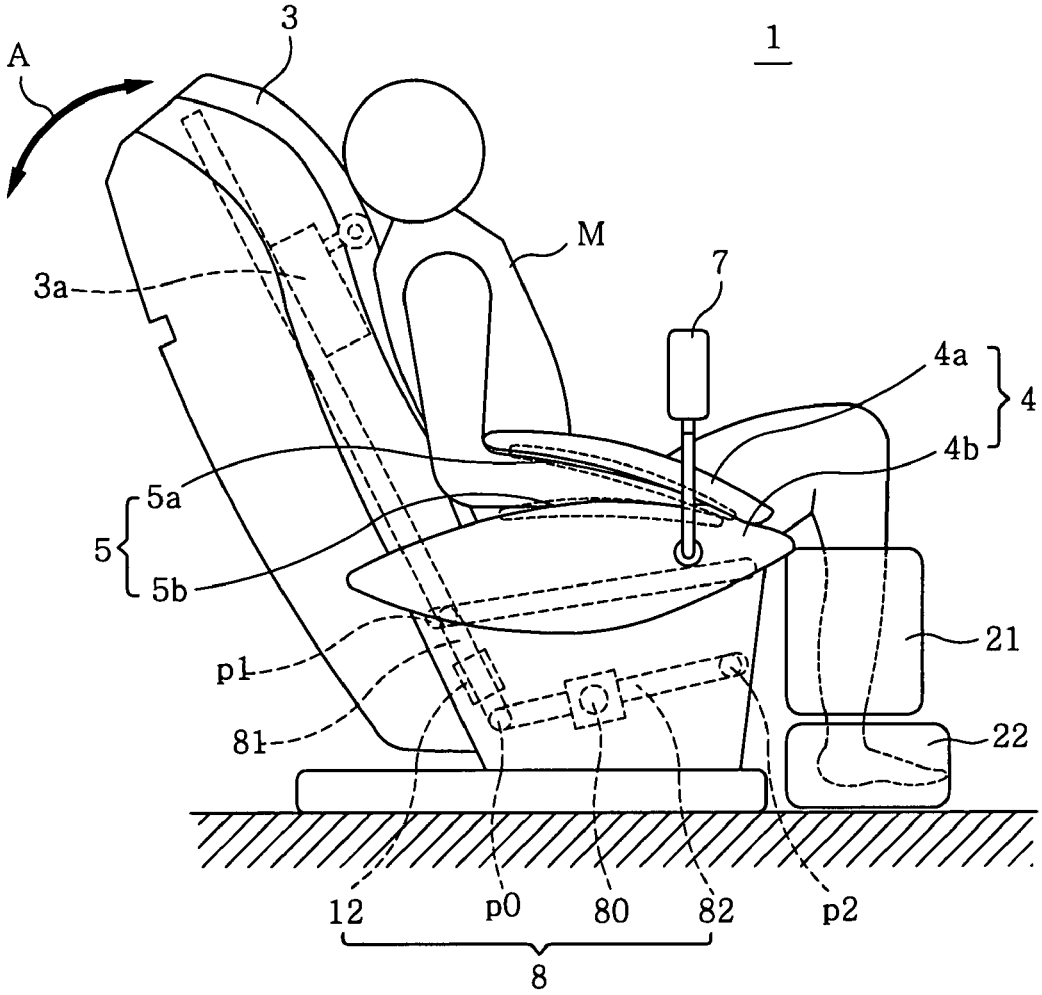
FIG. 2 is a side view of the chair type massager and a person to be treated before an arm stretching operation is performed by the massager.
Figure 3:
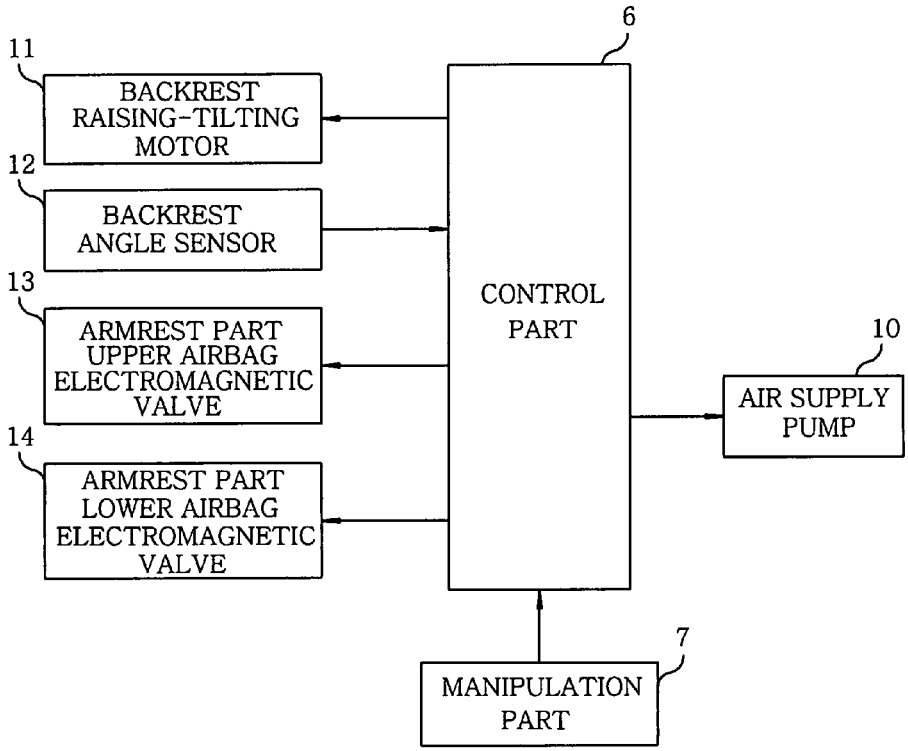
FIG. 3 is a control block diagram of the chair type massager.
Figure 4:
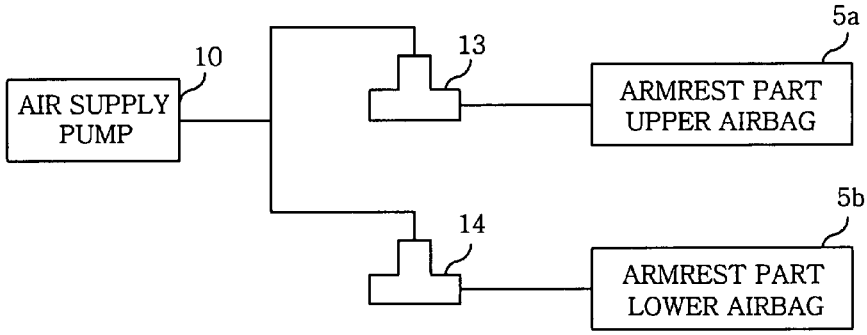
FIG. 4 is a block diagram that presents an air supply system for air bags of the chair type massager.

Hereinafter, exemplary embodiments of the present invention will be described in detail with reference to the accompanying drawings. FIG. 1 illustrates the appearance of a massager 1 in accordance with an embodiment of the present invention; FIG. 2 presents the massager on which a person M to be treated sits; FIG. 3 depicts a control block diagram of the massager 1; and FIG. 4 illustrates an air supply system for air bags of the massager 1.

The massager 1 is a chair type device which includes a seat part 2 on which the person M to be treated sits; a backrest part 3 having a reclining mechanism 8 that performs a raising/tilting operation; and right and left armrest parts 4 where the arms are placed. The massager further includes air bags 5 provided at the respective armrest parts 4 and expanded by air supplied from an air supply pump 10, the air bags 5 for fixedly holding arms placed in the armrest parts 4; a control part 6 that controls the raising/tilting operation of the backrest part 3 and controls air supply into the air bags 5; and a manipulation part 7 that allows the person M to be treated to give instructions to the control part 6.

The control part 6 controls the air supply by the air supply pump 10 so that the air supply into the air bags 5 is intermittently performed when the control part 6 controls the reclining mechanism 8 to tilt the backrest part 3 under operational instructions from the manipulation part 7 to perform an arm stretch.

With the aforementioned chair type massager 1, when the backrest part 3 is tilted to execute the stretching, since the air supply into the air bags 5 for holding arms is intermittently performed, the pressure in the air bags 5 can be properly maintained without being excessively increased. Therefore, the defects such as the oppressive sensation on arms, the obstruction of the bloodstream and the tiredness are prevented, so that the arm stretch can be comfortably performed. Furthermore, since an expensive pressure retaining valve (primary pressure regulating valve) is not required, the massager 1 is realized in a space-saving and inexpensive configuration.

Each component of the massager 1 will be described in more detail. A leg treatment part 21 and a foot treatment part 22 are provided at the front side of the seat part 2. Two legs (the calves) of the person M who sits on the seat part 2, are inserted into the leg treatment part 21. The feet of the person M are placed on and supported by the foot treatment part 22. Each of the leg treatment part 21 and the foot treatment part 22 includes a pair of concave recesses. An air bag that performs the swelling and shrinking operation by supplying and exhausting air is included in the side walls of each concave recess. The treatment parts 21, 22 hold legs from the calves to the ends of the feet of the person M to be treated and are capable of performing an air massage that applies pressure to wrap the left and right sides of each leg and foot by means of the air bags. Further, the treatment parts 21, 22 are capable of moving legs up and down by the rotary motion to up and down direction centering around the front end of the seat part 2, as indicated by arrow B in FIG. 1.

A mechanical massage unit 3*a* (massager) is provided in the backrest part 3. The massage unit 3*a* includes a treating element which is movable upward and downward and forward and backward on the back of the person M to be treated, who rests against the backrest part 3. The treating element is mechanically driven and performs a punching massage or a rubbing massage from the back to the shoulder of the person M to be treated. Further, the backrest part 3 can perform the raising/tilting operation by the reclining mechanism 8, as indicated by arrow A.

As illustrated in FIG. 2, the reclining mechanism 8 has a bar member 81 whose middle portion is rotatably fixed at a connection point p1 at the back side of the seat part 2 so that the bar member 81 can be rotated about the connection point p1; an extensible/contractible member 82 whose one end is rotatably fixed at a connection point p2 at the front side of the seat part 2 so that the extensible/contractible member 82 can be rotated about the connection point p2; and a link mechanism which rotatably connects the other end of the extensible/contractible member 82 to one end (lower end) of the bar member 81 at a connection point p0. The extensible/contractible member 82 includes an extension/contraction actuator 80 which is driven by a backrest raising/titling motor 11 (see FIG. 3). The actuator 80 has, for example, a screw and a nut. When the screw is rotated by the backrest raising/tilting motor 11, the relative positions of the screw and nut are moved so that the extensible/contractible member 82 is extended and contracted.

The bar member 81 is integrated with the backrest part 3. Accordingly, when the bar member 81 is rotated about the connection point p1 as the extensible/contractible member 82 is extended or contracted, the backrest part 3 simultaneously rotates about the connection point p1 and performs the raising/tilting operation. As illustrated in FIG. 3, the raising/tilting operation of the backrest part 3 is performed by the backrest raising/tilting motor 11 controlled by the control part 6. Further, a tilting angle of the backrest part 3 is controlled, for example, by using a signal from a backrest angle sensor 12 provided to measure a slope of the bar member 81.

The armrest part 4 includes a lower armrest part 4*b* and an upper armrest part 4*a* positioned about the lower armrest part 4*b*. The upper armrest part 4*a* and the lower armrest part 4*b* are arranged one over another with a space formed therebetween. The space becomes narrower as it goes from the backrest side toward the front side. Therefore, when viewed from the person M who sits on the seat part 2, the space in front of the person M is opened so that he or she can insert an arm between the upper armrest part 4*a* and the lower armrest part 4*b* from the opened side.

The air bag 5 includes an upper air bag 5*a* provided at the bottom surface of the upper armrest part 4*a*, and a lower air bag 5*b* provided at the top surface of the lower armrest part 4*b*. As illustrated in FIG. 4, the upper air bag 5*a* and the lower air bag 5*b* are line-connected to the air supply pump 10 via electromagnetic valves 13 and 14, respectively. The electromagnetic valves 13 and 14 convert air supply into air exhaustion by control signals or vice versa.

The air supply pump 10 is positioned under the seat part 2. The air bags 5 are swelled by air supplying, thereby wrapping respective arms of the person M to be treated from the upside and downside and holding the arms for an arm massage or arm or shoulder stretch.

The control part 6 controls the swelling and shrinking of each of the air bags 5*a* and 5*b* and the air bags of the leg treatment part 21 and foot treatment part 22 described above. The swelling and shrinking of the air bag is performed through the air supply to the air bag and the air exhaustion from the air bag by the air supply pump 10. The air supply and air exhaustion are performed by using an electromagnetic three-way valve or an electromagnetic opening/closing valve. The opening and closing control is performed by the control part 6. Further, the control part 6 performs the driving control of the mechanical massage unit 3*a* and the driving control of the reclining mechanism 8.

Figure 5:
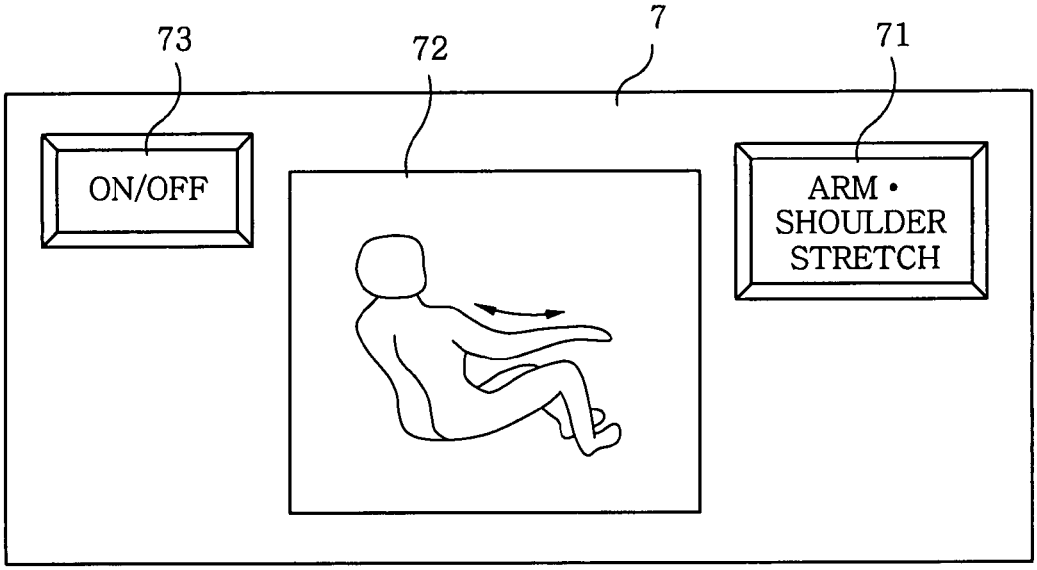
FIG. 5 is a view for explaining a manipulation part of the chair type massager.
Figure 6:
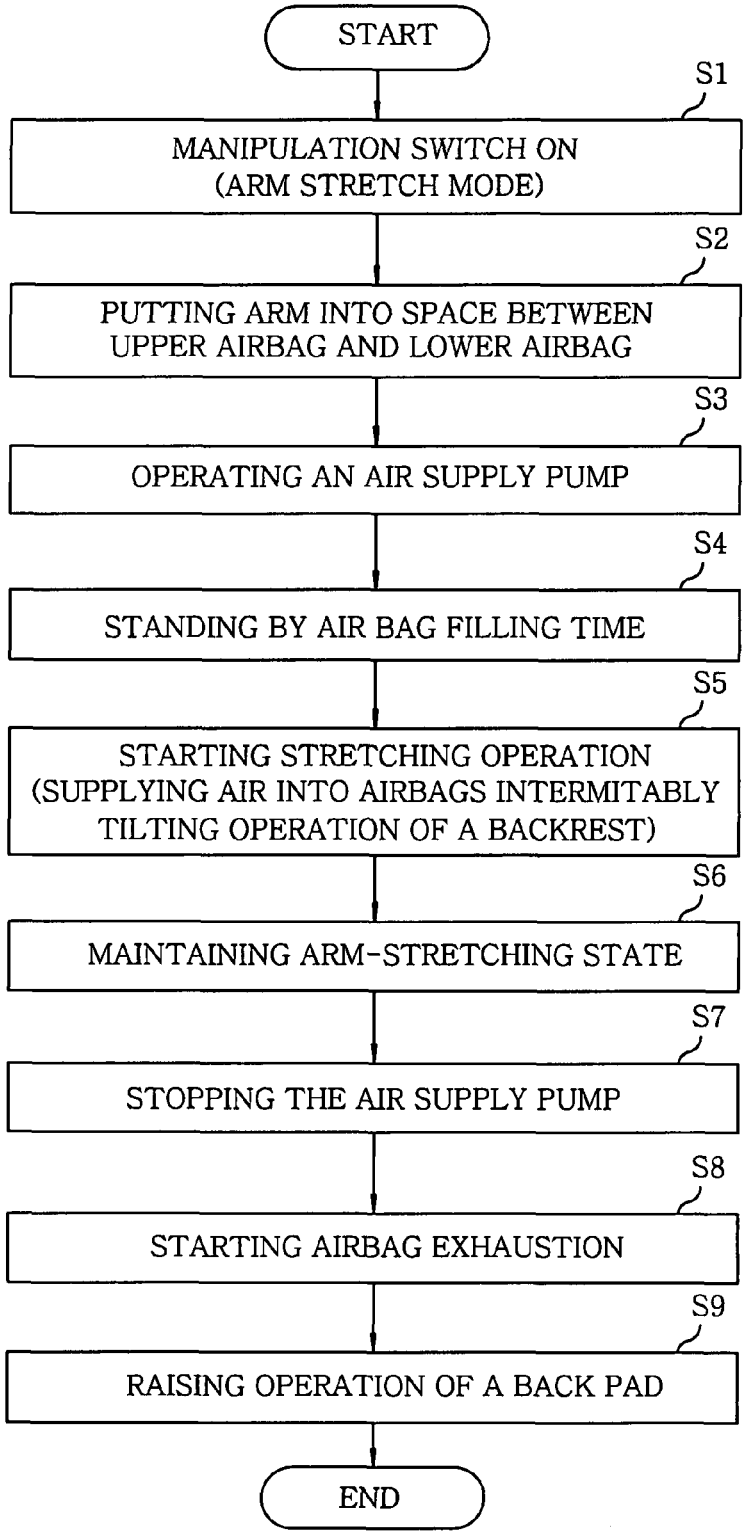
FIG. 6 is a flow chart of stretching operation by the chair type massager.
Figure 7:
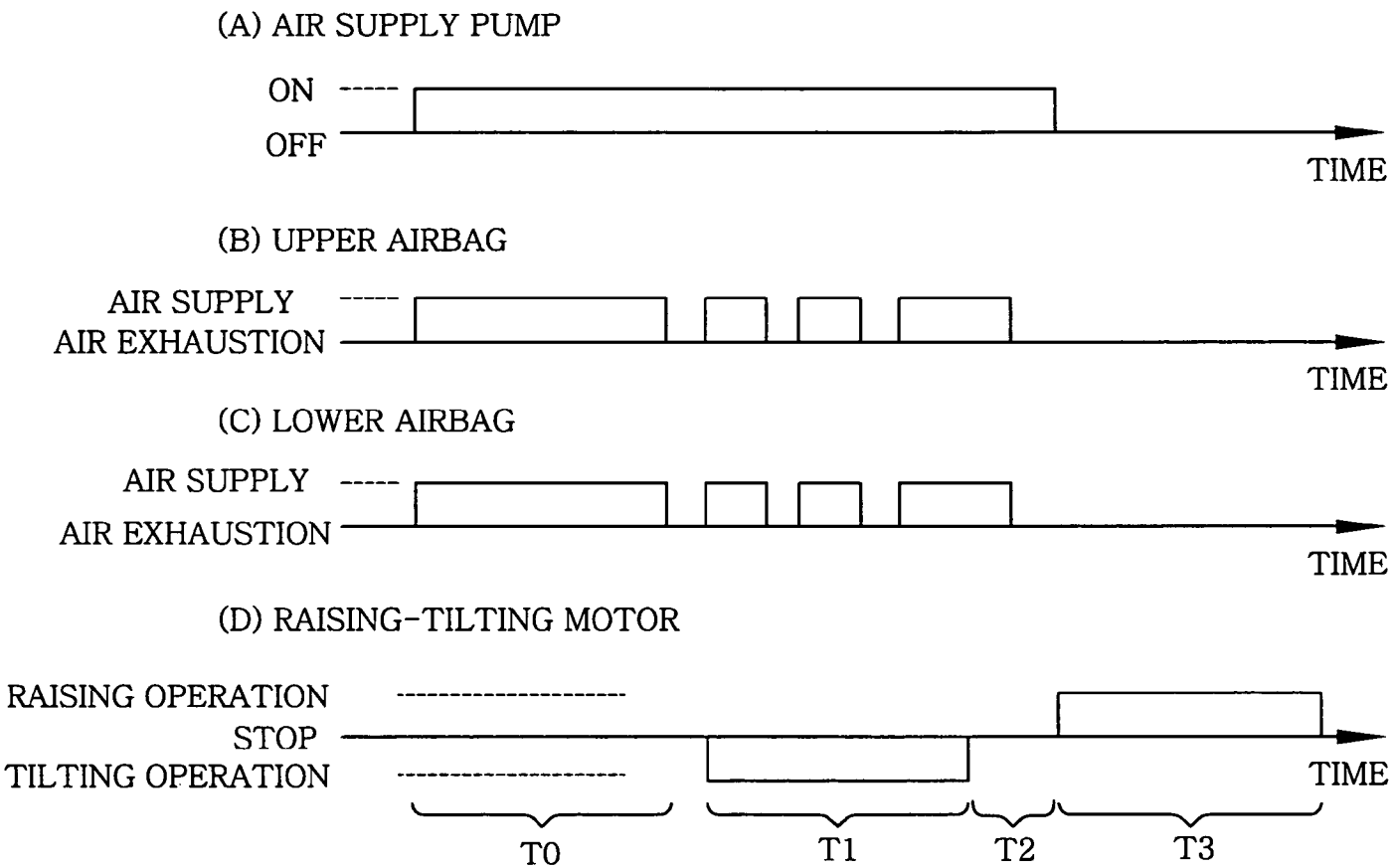
FIGS. 7A to 7D are operational timing diagrams of an air supply pump, upper and lower air bags and a raising/tilting motor upon the stretching operation by the chair type massager.
Figure 8:
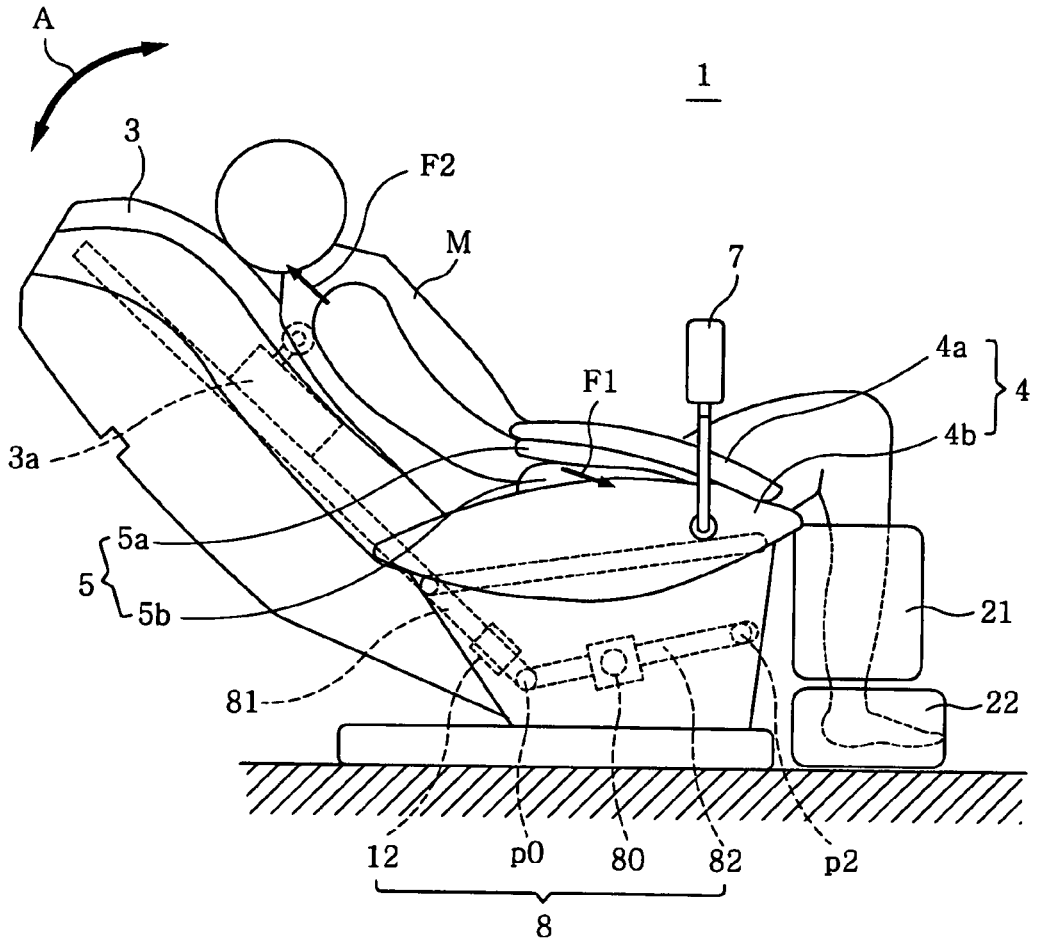
FIG. 8 is a side view of the chair type massager and the person to be treated during the stretching operation by the massager in accordance with the present invention.

Referring to FIGS. 5 to 8, a process flow of the arm stretch by the massager 1 will be described. FIG. 5 illustrates the manipulation part 7; FIG. 6 is a flow chart of the stretching operation; FIGS. 7A to 7D are operational timing diagrams of the air supply pump 10, the upper air bag 5A, the lower air bags 5*b* and the raising/tilting motor 11, respectively, upon the stretching operation by the massager 1; and FIG. 8 illustrates the massager 1 and the person M to be treated during the stretching operation. The stretching operation performs stretching for the whole arm and further the shoulder continued from the arm.

The person M sitting on the seat part 2 can adjust the backrest part 3 at his/her preferred tilting angle. While watching a display part 72 of the manipulation part 7 as illustrated in FIG. 5, the person M presses an ON/OFF switch 73 and presses an arm-shoulder stretch button 71 (step S1) and inserts each arm between the upper armrest part 4*a* and the lower armrest part 4*b*, that is, between the corresponding upper and lower air bags (step S2). Then, the air supply pump 10 operates to start treatment (step S3).

At the same time when the operation of the air supply pump 10 starts, the control part 6 controls the electromagnetic valves 13 and 14 so that the air is supplied into the upper air bags 5*a* and lower air bags 5*b* as illustrated in FIGS. 7A to 7C and the massager gets into a waiting state for air bag filling for a time T0, as illustrated in FIG. 7D (step S4). The waiting time for the air bag filling is the time taken for the air bag pressure to reach the minimum pressure required to hold the arm (between the wrist and the elbow) for the arm stretch. The time T0 can be previously set.

When the time T0 has elapsed and an optimum state for holding arms is established by the air bags 5, the control part 6 starts the stretching operation (step S5). The stretching operation of step S5 is performed by moving back the shoulder of the person M to be treated by the tilting operation of the backrest part 3 while maintaining the pressure applied to the arms at the optimum pressure by intermittently supplying and exhausting air into and from the air bags 5. The tilting operation of the backrest part 3 is executed for a time T1. Specifically, the pressure control by the intermittent air supply and exhaustion into and from the air bags 5 is effective when certain time is required for tilting the backrest part 3, that is, when the time T1 becomes longer, for example, when the backrest part 3 needs to be tilted at a great angle or to be slowly tilted avoiding any rapid operation.

The body of the person M is tilted backward by the above-described tilting operation and by the gravity. For a time T2 after the backrest part 3 is tilted at a given final angle, the massager 1 and the person M are maintained as they are, that is, to be in a stretching state (step S6). This is effective to increase the stretching effect. Further, to increase the stretching effect, it is preferable to perform only the air supply for several seconds at the end of the intermittent air supply and exhaustion and to continue the operation of stretching the shoulders from the arms so that the arms are pulled by a force F1 and the shoulder parts are pulled by a force F2, as illustrated in FIG. 8.

Then, the air supply pump 10 stops (step S7), the air exhaustion from the air bag starts (step S8), and the raising operation of the backrest part 3 is performed for a time T3 (step S9), thereby finishing the arm stretch performed by the one-time reclining operation.

While the invention has been shown and described with respect to the embodiments, it will be understood by those skilled in the art that various changes and modifications may be made without departing from the scope of the invention. For example, in the embodiment of the present invention illustrated in FIGS. 3 and 4, the upper and lower electromagnetic valves 13 and 14 are provided respectively for the upper and lower air bags 5*a* and 5*b*, and each electromagnetic valve is commonly used for the corresponding right and left air bags. However, two electromagnetic valves may be further provided in addition to the electromagnetic valves 13 and 14. That is, the air supply and exhaustion may be independently performed to four air bags 5 provided at the top surface and bottom surfaces of the left and right armrest parts 4 by using the four electromagnetic valves. In this case, the body can be tilted backward or the shoulders can be twisted in the state that one arm is fixed and the other arm is free, thereby enabling to more effectively stretch the arms or shoulders of the person M to be treated and performing the efficient stretching operation. In this case, since one of the arms is free, the person M to be treated can feel relieved.

Further, while stretching the arms, the combined operations may be performed by using the leg treatment part 21 and the foot treatment part 22 that enable to massage the leg parts by the air bag or to move the legs up and down. Further, instead of controlling the pressure of the air bags 5 by the intermittent air supply into the air bags 5, the pressure may be adjusted by controlling the driving of the air supply pump 10, for example, by repeatedly stopping and operating the air supply pump 10. In this case, the electromagnetic valve may be substituted with leak apertures that exhaust the air naturally from the air bag. Further, although the air bags 5 for fixedly holding the arms are provided at the armrest parts 4 one over another in the embodiment of the present invention, the positions of the air bags are not limited thereto. For example, the air bags may be provided at the right and left sides of the each arm to hold it. Further, ring-shaped air bags may be used to hold the arms.

What is claimed is:

1. A chair type massager comprising:

a seat part on which a person to be treated sits on;

a backrest part with a reclining mechanism that performs raising/tilting operation;

right and left armrest parts in which arms are placed;

air bags provided at the armrest parts, the air bags holding the arms placed in the armrest parts by being swelled by air supplied from an air supply pump;

a control part for controlling the raising/tilting operation of the backrest part and air supply into the air bags; and a manipulation part for giving instructions to the control part, wherein, when controlling the reclining mechanism to tilt the backrest part in response to an instruction from the manipulation part to perform an arm stretch operation, the control part controls the air supply pump such that the air is supplied into the airbags in a first manner before the backrest part is being tilted, a second manner while the backrest part is being tilted, a third manner while the backrest part is tilted at a threshold angle and a fourth manner while the backrest part is being raised, and wherein at least two of the first manner, the second manner, the third manner and the fourth manner are different from each other.

2. The chair type massager of claim 1, wherein the air is supplied into the airbags continuously in the first manner and intermittently in the second manner.

3. The chair type massager of claim 2, wherein the air is supplied into the airbags continuously for several seconds and then the air is exhausted from the airbags in the third manner.

4. The chair type massager of claim 3, wherein the air is not supplied into the airbags in the fourth manner.

* * * * *